US012727670B2

(12) United States Patent
Chen et al.

(10) Patent No.: US 12,727,670 B2
(45) Date of Patent: Sep. 8, 2026

(54) SUPPORTING ASSEMBLY

(71) Applicants: KING SLIDE WORKS CO., LTD., Kaohsiung City (TW); KING SLIDE TECHNOLOGY CO., LTD., Kaohsiung City (TW)

(72) Inventors: Ken-Ching Chen, Kaohsiung City (TW); Shun-Ho Yang, Kaohsiung City (TW); Ding-Yan Yu, Kaohsiung City (TW); Chun-Chiang Wang, Kaohsiung City (TW)

(73) Assignees: KING SLIDE WORKS CO., LTD., Kaohsiung City (TW); KING SLIDE TECHNOLOGY CO., LTD., Kaohsiung City (TW)

( * ) Notice: Subject to any disclaimer, the term of this patent is extended or adjusted under 35 U.S.C. 154(b) by 134 days.

(21) Appl. No.: 18/645,340

(22) Filed: Apr. 24, 2024

(65) Prior Publication Data

US 2025/0098855 A1 Mar. 27, 2025

(30) Foreign Application Priority Data

Sep. 23, 2023 (TW) ..... 112136566

(51) Int. Cl.
*A47B 88/43* (2017.01)

(52) U.S. Cl.
CPC ..... *A47B 88/43* (2017.01)

(58) Field of Classification Search
CPC ..... H05K 7/1489; A47B 88/1489
See application file for complete search history.

(56) References Cited

U.S. PATENT DOCUMENTS 4,469,384 A * 9/1984 Fler ..... A47B 88/493 312/333
6,807,062 B2 * 10/2004 Lauchner ..... H05K 7/1421 361/725
7,604,307 B2 * 10/2009 Greenwald ..... A47B 88/49 312/334.46

(Continued)

FOREIGN PATENT DOCUMENTS

JP 2009-283937 A 12/2009
JP 3174191 U 3/2012

(Continued)

*Primary Examiner* — Monica E Millner
(74) *Attorney, Agent, or Firm* — Winston Hsu

(57) ABSTRACT

A supporting assembly adapted for a rack is provided and includes a supporting bracket, a plurality of slide rails, a plurality of movable rails and a plurality of supporting rails. The supporting bracket is configured to be mounted on the rack and includes a first predetermined end portion and a second predetermined end portion. The plurality of slide rails are configured to be detachably mounted on the supporting bracket. The plurality of supporting rails are movably mounted on the plurality of movable rails movably mounted on the plurality of slide rails, respectively. Each of the plurality of slide rails includes a first end portion, a second end portion, and a middle portion located between the first end portion and the second end portion. The first predetermined end portion of the supporting bracket protrudes from the first end portion of each of the plurality of slide rails along a longitudinal direction.

18 Claims, 7 Drawing Sheets

(56) References Cited

U.S. PATENT DOCUMENTS

| | | | | |
|---|---|---|---|---|
| 8,925,739 | B2 * | 1/2015 | Crippen | H05K 7/1488 312/265.3 |
| 9,474,182 | B1 * | 10/2016 | Chen | A47B 88/493 |
| 9,629,276 | B2 * | 4/2017 | Sampath | H05K 7/1489 |
| 9,675,175 | B1 * | 6/2017 | Chen | A47B 88/483 |
| 9,681,573 | B2 * | 6/2017 | Chen | A47B 88/40 |
| 9,723,746 | B2 * | 8/2017 | Chen | A47B 88/43 |
| 9,867,308 | B2 * | 1/2018 | Chen | A47B 96/067 |
| 9,924,611 | B2 | 3/2018 | Tonthat | |
| 10,791,833 | B2 | 10/2020 | Chen | |
| 11,213,123 | B2 * | 1/2022 | Chen | A47B 88/493 |
| 11,439,036 | B2 | 9/2022 | Chen | |
| 11,576,277 | B2 | 2/2023 | Chen | |
| 11,895,800 | B2 | 2/2024 | Chapel | |
| 2003/0141791 | A1 | 7/2003 | Dubon | |
| 2004/0090750 | A1 | 5/2004 | Lauchner | |
| 2004/0159618 | A1 * | 8/2004 | Nguyen | H05K 7/1489 312/265.4 |
| 2011/0011817 | A1 | 1/2011 | Yamakawa | |
| 2015/0201754 | A1 * | 7/2015 | Chen | A47B 96/07 248/219.3 |
| 2017/0340111 | A1 * | 11/2017 | Chen | A47B 88/41 |
| 2018/0199714 | A1 * | 7/2018 | Chen | A47B 88/423 |
| 2022/0087421 | A1 * | 3/2022 | Chen | H05K 7/183 |
| 2024/0324135 | A1 * | 9/2024 | Liu | H05K 7/1489 |
| 2024/0410421 | A1 * | 12/2024 | Chen | F16C 29/02 |
| 2025/0089891 | A1 * | 3/2025 | Chen | A47B 88/57 |

FOREIGN PATENT DOCUMENTS

| | | | |
|---|---|---|---|
| JP | 3189902 | U | 4/2014 |
| JP | 2017-131622 | A | 8/2017 |
| JP | 2020-81838 | A | 6/2020 |
| JP | 2021-30055 | A | 3/2021 |
| JP | 2021-171624 | A | 11/2021 |
| JP | 2022-53472 | A | 4/2022 |

* cited by examiner

SUPPORTING ASSEMBLY

BACKGROUND OF THE INVENTION

1. Field of the Invention

The present invention relates to a slide rail mechanism, and more specifically, to a supporting assembly with a supporting bracket for mounting a plurality of slide rails onto a rack.

2. Description of the Prior Art

In U.S. Pat. No. 9,924,611 B2, it discloses a connector assembly for mounting a plurality of slide rails onto a rack system. The rack system includes at least four posts positioned at different corners to form a rack frame having a front portion, a rear portion, a top portion, a bottom portion and two lateral portions. Each of the posts includes a plurality of openings. The connector assembly includes two front connectors and two rear connectors. Each of the two front connectors and the two rear connectors includes a base plate extending from the top portion of the rack frame to the bottom portion of the rack frame and configured to be secured to the plurality of slide rails.

However, in order to meet various requirements, it becomes an important topic to provide an alternative solution for mounting a plurality of slide rails onto a rack with easy operation.

SUMMARY OF THE INVENTION

The present invention is to provide a supporting assembly with a supporting bracket for mounting a plurality of slide rails onto a rack.

According to an aspect of the present invention, a supporting assembly is adapted for a rack and includes a supporting bracket, a plurality of slide rails, a first movable rail, a second movable rail, a first supporting rail and a second supporting rail. The supporting bracket is configured to be mounted on the rack. The supporting bracket includes a first predetermined end portion and a second predetermined end portion opposite to the first predetermined end portion along a longitudinal direction. The plurality of slide rails are configured to be detachably mounted on the supporting bracket and include a first slide rail and a second slide rail. Each of the plurality of slide rails includes a first end portion, a second end portion and a middle portion. The second end portion is opposite to the first end portion along the longitudinal direction. The middle portion is located between the first end portion and the second end portion along the longitudinal direction. The first movable rail is movably mounted on the first slide rail. The second movable rail is movably mounted on the second slide rail. The first supporting rail is movably mounted on the first movable rail. The second supporting rail is movably mounted on the second movable rail. One of the first supporting rail and the second supporting rail is configured to support a carried object. The first predetermined end portion of the supporting bracket protrudes from the first end portion of each of the plurality of slide rails along the longitudinal direction.

According to an aspect of the present invention, a supporting assembly includes a supporting bracket and a plurality of slide rails. The supporting bracket includes a first predetermined end portion, a second predetermined end portion and a main body portion. The second predetermined end portion is opposite to the first predetermined end portion along a longitudinal direction. The main body portion is connected between the first predetermined end portion and the second predetermined end portion along the longitudinal direction. The plurality of slide rails are configured to be detachably mounted on the supporting bracket and includes a first slide rail and a second slide rail. The first slide rail and the second slide rail have substantially identical structures. Each of the plurality of slide rails includes a first end portion, a second end portion and a middle portion. The second end portion is opposite to the first end portion along the longitudinal direction, and the middle portion is located between the first end portion and the second end portion along the longitudinal direction. Each of the plurality of slide rails further includes a first lateral side and a second lateral side along a transverse direction. The first lateral side is located adjacent to the supporting bracket, and a channel is formed on the second lateral side and for allowing a movable rail to be mounted thereon. A predetermined structure is arranged on one of the supporting bracket and each of the plurality of slide rails, and the predetermined structure includes a protruding portion configured to abut against another one of the supporting bracket and each of the plurality of slide rails.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "left", "right", "front", "back", etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive. Also, if not specified, the term "connect" is intended to mean either an indirect or direct mechanical connection. Thus, if a first device is connected to a second device, that connection may be through a direct mechanical connection, or through an indirect mechanical connection via other devices and connections.

Figure 1:
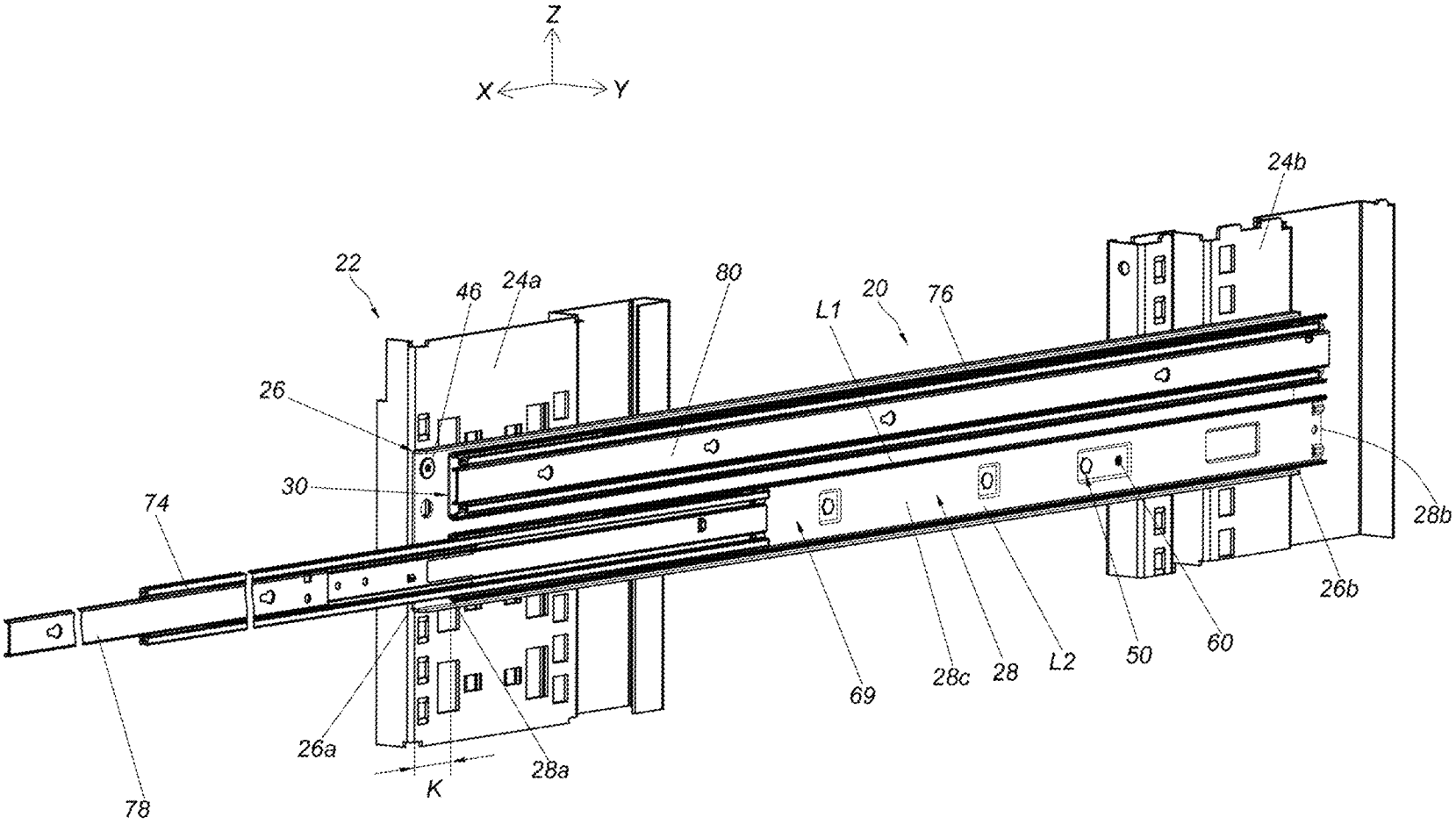
FIG. 1 is a perspective diagram of a supporting assembly according to an embodiment of the present invention.

As shown in FIG. 1, a supporting assembly 20 is adapted for a rack 22. In this embodiment, by way of example, the rack 22 includes at least one post, and the at least one post includes a first post 24*a* and a second post 24*b*. However, the present invention is not limited to this embodiment.

The supporting assembly 20 includes a supporting bracket 26 and a plurality of slide rails. In this embodiment, by way of example, the plurality of slide rails at least include a first slide rail 28 and a second slide rail 30. However, the present invention is not limited to this embodiment. For example, in another embodiment, the plurality of slide rails can include more slide rails. Besides, as shown in FIG. 1, in this embodiment, by way of example, a longitudinal direction can be defined by a length direction of a slide rail, e.g., the first slide rail 28 or the second slide rail 30, and parallel to an X axis. A transverse direction can be defined by a lateral direction or a width direction of the slide rail and parallel to a Y axis. A vertical direction can be defined by a height direction of the slide rail and parallel to a Z axis.

The supporting bracket 26 is configured to be mounted on the first post 24*a* and the second post 24*b* of the rack 22. The supporting bracket 26 includes a first predetermined end portion 26*a* and a second predetermined end portion 26*b* opposite to the first predetermined end portion 26*a* along the longitudinal direction. In this embodiment, by way of example, the first predetermined end portion 26*a* and the second predetermined end portion 26*b* of the supporting bracket 26 are a front predetermined end portion and a rear predetermined end portion of the supporting bracket 26, respectively. However, the present invention is not limited to this embodiment.

The first slide rail 28 and the second slide rail 30 are configured to be detachably mounted on the supporting bracket 26. The first slide rail 28 and the second slide rail 30 can have substantially identical structures, and a structural configuration of the first slide rail 28 and the supporting bracket 26 can be substantially identical to a structural configuration of the second slide rail 30 and the supporting bracket 26. Detailed description for the structural configuration of the first slide rail 28 and the supporting bracket 26 is provided as follows, and detailed description for the structural configuration of the structural configuration of the second slide rail 30 and the supporting bracket 26 is omitted herein for simplicity.

The first slide rail 28 includes a first end portion 28*a*, a second end portion 28*b* and a middle portion 28*c*. The first end portion 28*a* and the second end portion 28*b* are opposite to each other along the longitudinal direction. In this embodiment, by way of example, the first end portion 28*a* and the second end portion 28*b* of the first slide rail 28 are a front end portion and a rear end portion of the first slide rail 28, respectively. However, the present invention is not limited to this embodiment. The middle portion 28*c* is connected to and located between the first end portion 28*a* and the second end portion 28*b* along the longitudinal direction.

The first predetermined end portion 26*a* of the supporting bracket 26 protrudes from the first end portion 28*a* of the first slide rail 28 along the longitudinal direction by a predetermined distance K. The second predetermined end portion 26*b* of the supporting bracket 26 is located between the middle portion 28*c* and the second end portion 28*b* of the first slide rail 28 along the longitudinal direction. Furthermore, the second predetermined end portion 26*b* of the supporting bracket 26 is located adjacent to the first slide rail 28, so as to be located between the middle portion 28*c* of the first slide rail 28 and the second end portion 28*b* of the first slide rail 28 along the longitudinal direction.

Preferably, the second predetermined end portion 26*b* of the supporting bracket 26 is located away from the first predetermined end portion 26*a* of the supporting bracket 26 by a predetermined longitudinal distance, such that the second predetermined end portion 26*b* of the supporting bracket 26 is located adjacent to the second end portion 28*b* of the first slide rail 28.

Figure 2:
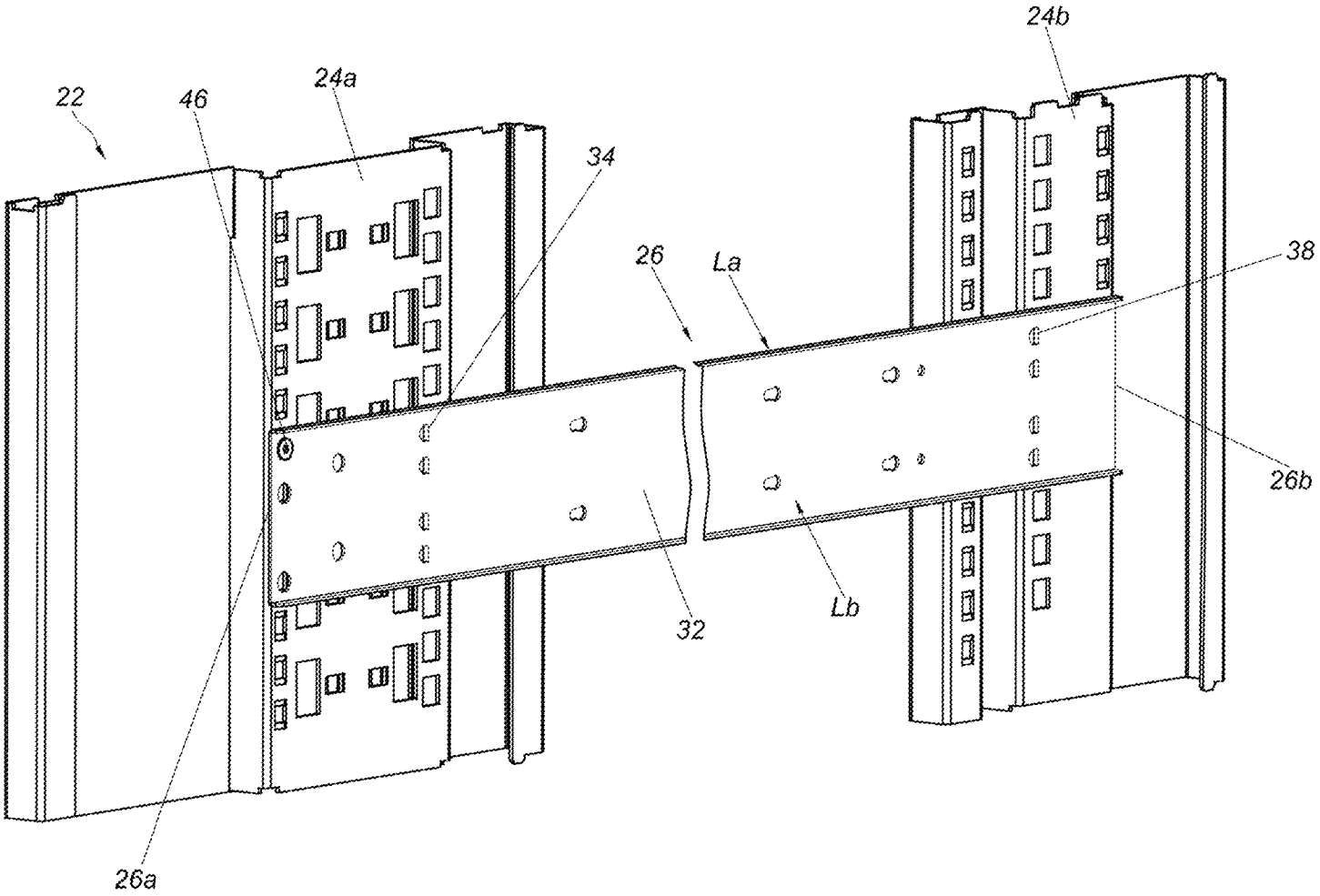
FIG. 2 and FIG. 3 are partial diagrams of the supporting assembly at different views as a supporting bracket is mounted on a rack according to the embodiment of the present invention.
Figure 3:
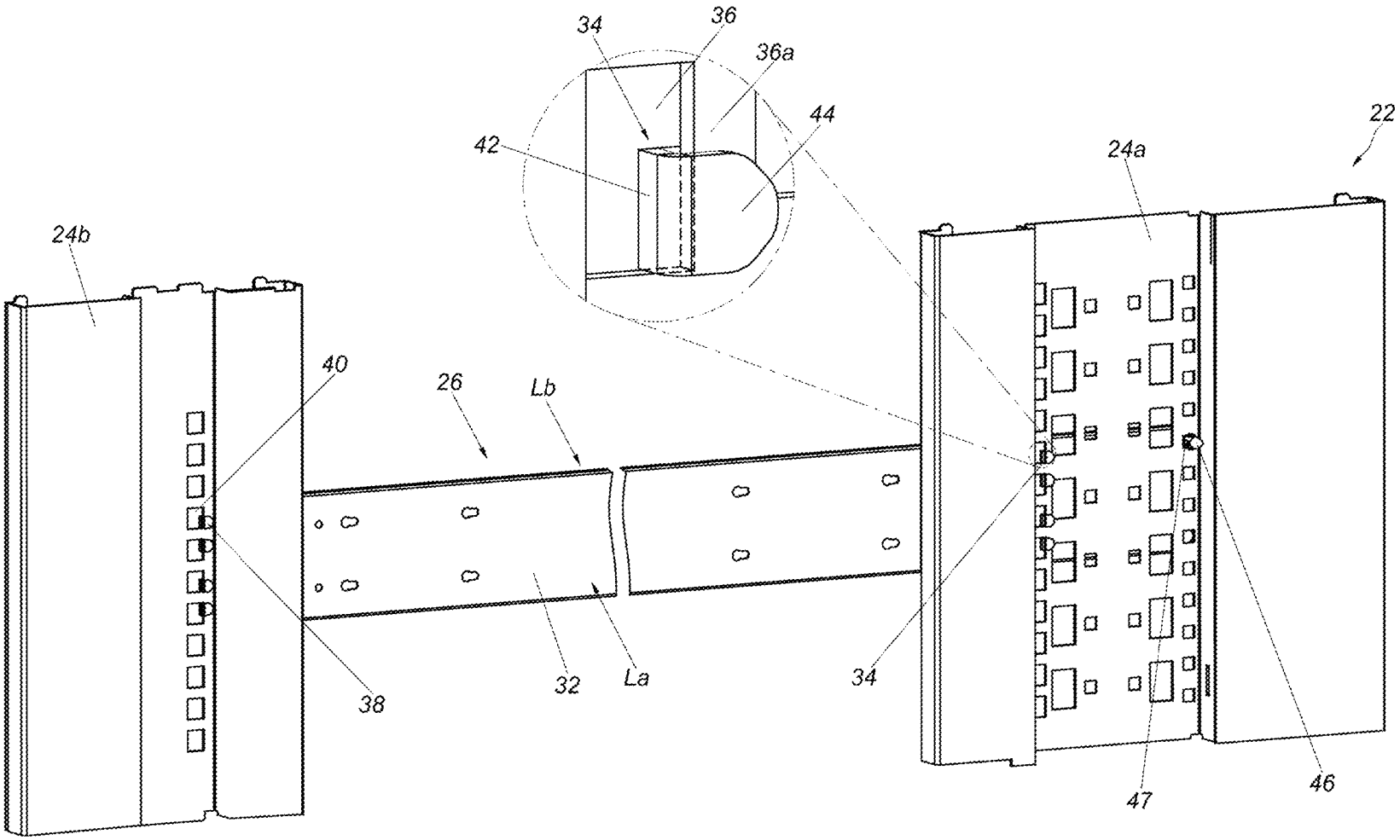

As shown in FIG. 2 and FIG. 3, the supporting bracket 26 includes a main body portion 32 connected between the first predetermined end portion 26*a* and the second predetermined end portion 26*b* of the supporting bracket 26 along the longitudinal direction. The supporting bracket 26 includes a first predetermined lateral side La and a second predetermined lateral side Lb opposite to the first predetermined lateral side La along the transverse direction. The first predetermined lateral side La is located adjacent to or faces toward the rack 22.

Preferably, at least one first mounting feature 34 is arranged on the main body portion 32 of the supporting bracket 26 and configured to be mounted on at least one first corresponding feature 36 on the rack 22. As shown in FIG. 3, by way of example, in this embodiment, the first corresponding feature 36 is a first corresponding hole, and the first mounting feature 34 extends from the second predetermined lateral side Lb to the first predetermined lateral side La. However, the present invention is not limited to this embodiment.

Preferably, at least one second mounting feature 38 is arranged on the main body portion 32 of the supporting bracket 26 and configured to be mounted on at least one second corresponding feature 40 on the rack 22. As shown in FIG. 3, by way of example, in this embodiment, the second corresponding feature 40 is a second corresponding hole, and the second mounting feature 38 extends from the second predetermined lateral side Lb to the first predetermined lateral side La. However, the present invention is not limited to this embodiment.

Preferably, as shown in FIG. 2, the first mounting feature 34 and the second mounting feature 38 can have substantially identical structures, and the first mounting feature 34 and the second mounting feature 38 are located adjacent to the first predetermined end portion 26*a* and the second predetermined end portion 26*b* of the supporting bracket 26, respectively. In this embodiment, by way of example, each of the first mounting feature 34 and the second mounting feature 38 is a protrusion which includes a first segment 42 transversely connected to the main body portion 32 and a second segment 44 bent relative to the first segment 42. For example, as shown in FIG. 3, the first segment 42 and the second segment 44 of the first mounting feature 34 are perpendicular to each other, such that the first segment 42 and the second segment 44 of the first mounting feature 34 can cooperatively engage with an edge 36*a* of the first corresponding feature 36 for restraining a movement of the supporting bracket 26 relative to the rack 22 along the transverse direction.

Preferably, the supporting assembly 20 further includes a first connecting member 46 configured to fix the supporting bracket 26 onto the rack 22. For example, the first connecting member 46 can be a screw member, a bolt member or any other fastening member. Furthermore, the first connecting member 46 is configured to be immovably mounted on a third corresponding feature 47 on the rack 22 by passing through the main body portion 32 of the supporting bracket 26. For example, as shown in FIG. 3, the third corresponding feature 47 is a third corresponding hole.

Figure 4:
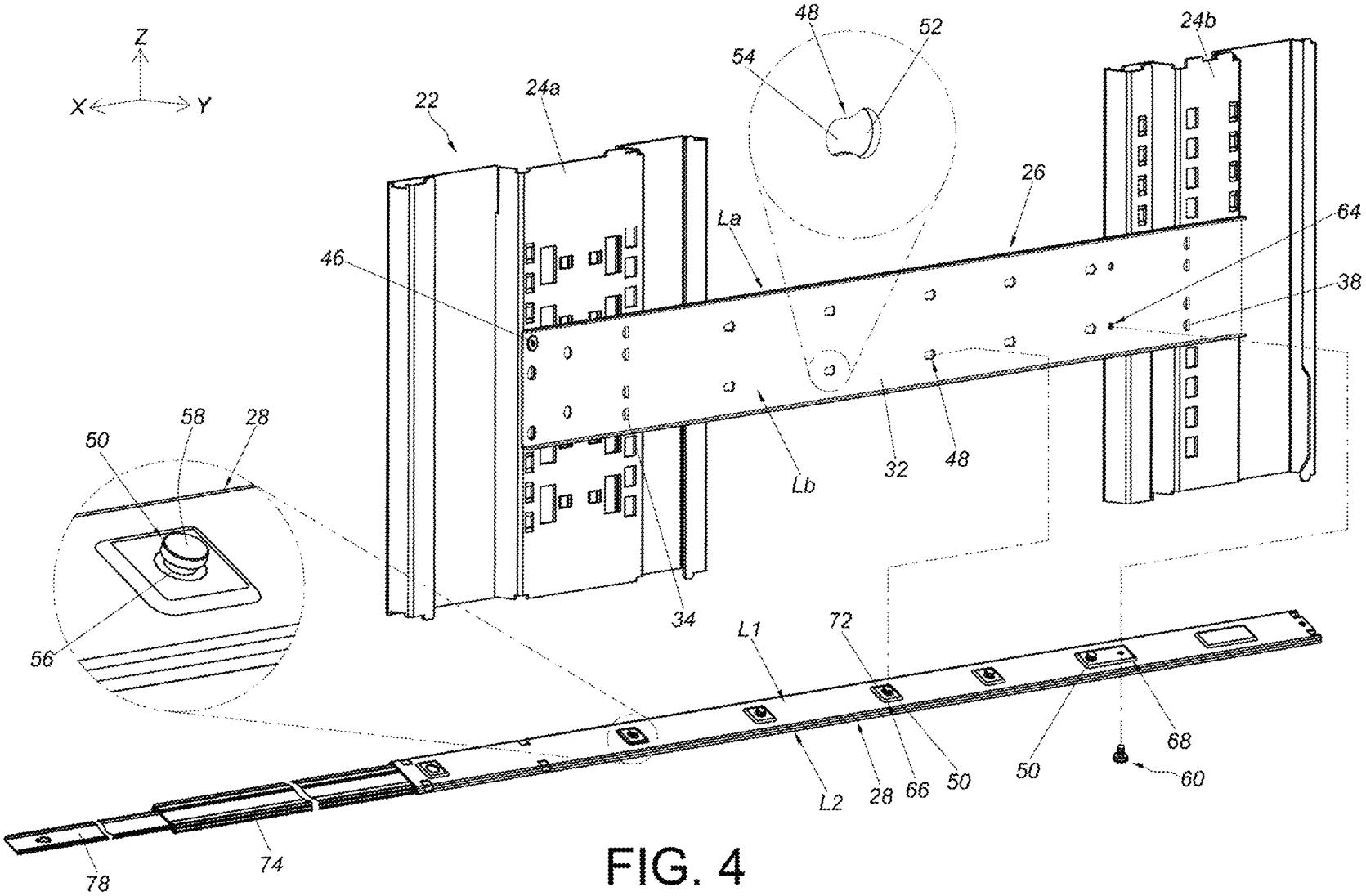
FIG. 4 is a diagram of the supporting assembly as a first slide rail is detached from the supporting bracket according to the embodiment of the present invention.

As shown in FIG. 4, a plurality of mounting structures 48 are further arranged on the main body portion 32 of the supporting bracket 26 at intervals along the longitudinal direction and located between the first mounting feature 34 and the second mounting feature 38. As shown in FIG. 1 and FIG. 4, the first slide rail 28 or the second slide rail 30 is configured to be mounted on the plurality of mounting structures 48, so as to be located adjacent to the second predetermined lateral side Lb of the supporting bracket 26.

Preferably, as shown in FIG. 4, the plurality of mounting structures 48 are a plurality of key hole structures, and at least one auxiliary member 50 is arranged on the first slide rail 28 or the second slide rail 30 and configured to be mounted onto the plurality of key hole structures. For example, each of the plurality of mounting structures 48 includes a first predetermined hole portion 52 and a second predetermined hole portion 54 communicated with the first predetermined hole portion 52 and extending along the longitudinal direction, and a size of the first predetermined hole portion 52 is greater than a size of the second predetermined hole portion 54. Specifically, a plurality of auxiliary members 50 are arranged on the first slide rail 28, and each of the plurality of auxiliary members 50 includes a body portion 56 connected to the first slide rail 28 and a head portion 58 extending from the body portion 56, and a size of the head portion 58 is greater than a size of the body portion 56. Besides, the size of the head portion 58 is less than the size of the first predetermined hole portion 52 and greater than the size of the second predetermined hole portion 54.

As shown in FIG. 4 to FIG. 7, when it is desired to mount the first slide rail 28 on the supporting bracket 26, the body portion 56 of the auxiliary member 50 can be moved to pass through the first predetermined hole portion 52 of the mounting structure 48. After the body portion 56 of the auxiliary member 50 is moved to pass through the first predetermined hole portion 52 of the mounting structure 48, a user can apply a force onto the first slide rail 28 along a first predetermined direction D1 to drive the first slide rail 28 to move from a first mounting position M1 to a second mounting position M2 along the first predetermined direction D1, such that the head portion 58 of the auxiliary member 50 can move from a position corresponding to the first predetermined hole portion 52 to a position corresponding to the second predetermined hole portion 54, so as to restrain a movement of the first slide rail 28 relative to the supporting bracket 26 along the transverse direction by abutment of the head portion 58 of the auxiliary member 50 and a wall of the second predetermined hole portion 54 along the transverse direction.

It should be noticed that when it is desired to detach the first slide rail 28 from the supporting bracket 26, the user can apply another force onto the first slide rail 28 along a second predetermined direction D2 opposite to the first predetermined direction D1 to drive the first slide rail 28 from the second mounting position M2 to the first mounting position M1 along the second predetermined direction D2, so as to allow detachment of the first slide rail 28 from the supporting bracket 26 by withdrawal of the head portion 58 of the auxiliary member 50 from the first predetermined hole portion 52 of the mounting structure 48.

Figure 5:
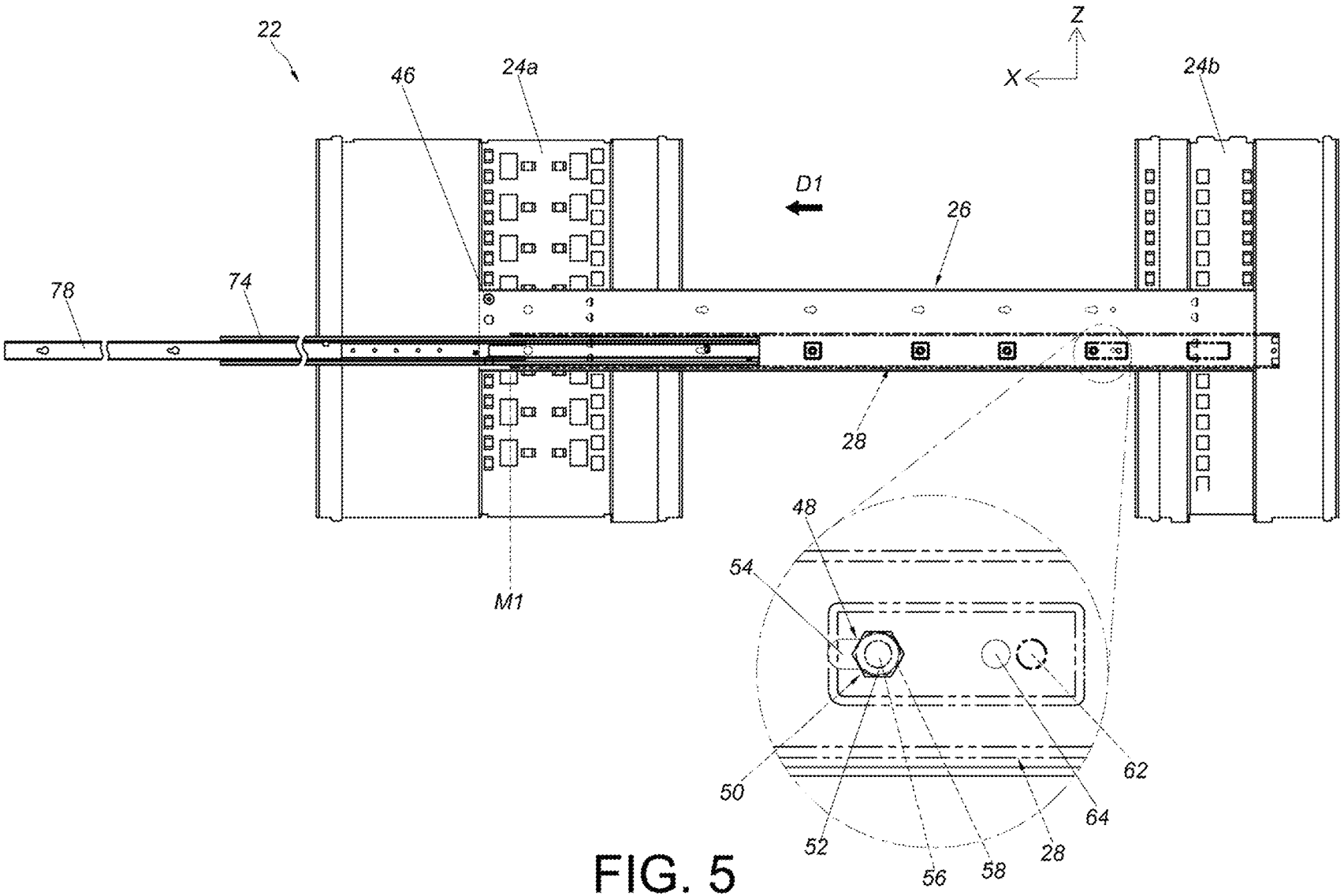
FIG. 5 and FIG. 6 are diagrams of the supporting assembly as the first slide rail is located at different positions relative to the supporting bracket according to the embodiment of the present invention.
Figure 6:
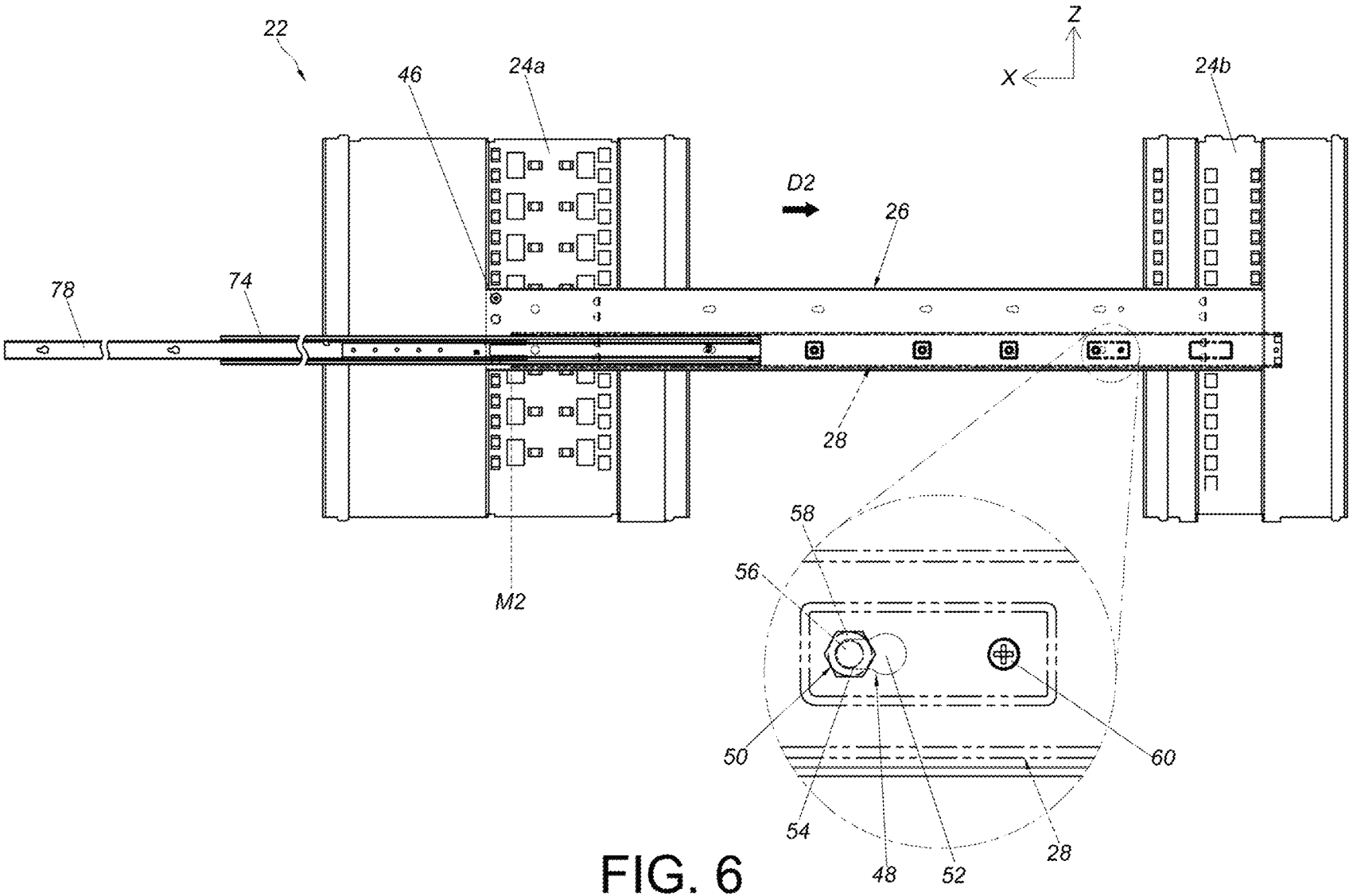
Figure 7:
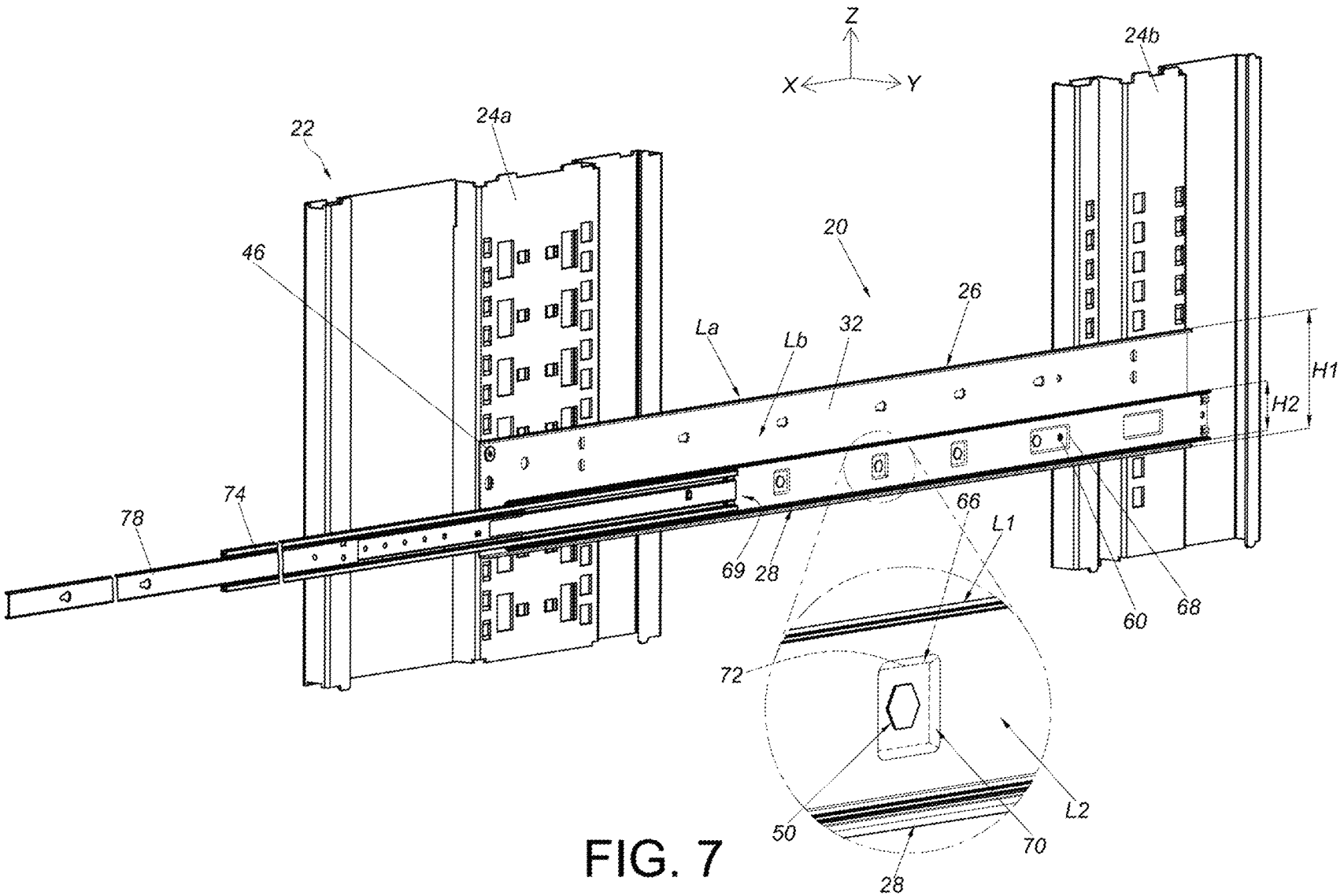
FIG. 7 is a diagram of the supporting assembly as the first slide rail is mounted on the supporting bracket according to the embodiment of the present invention.

Preferably, the supporting assembly 20 further includes a second connecting member 60. As shown in FIG. 4, FIG. 6 and FIG. 7, after the first slide rail 28 moves to the second mounting position M2, i.e., after the head portion 58 of the auxiliary member 50 is abutted by the wall of the second predetermined hole portion 54 along the transverse direction, the second connecting member 60 is configured to fix the first slide rail 28 onto the supporting bracket 26. For example, the second connecting member 60 can be a screw member, a bolt member or any other fastening member. Furthermore, as shown in FIG. 5, the first slide rail 28 includes a first connecting hole 62, and the supporting bracket 26 includes a second connecting hole 64 configured to cooperate with the first connecting hole 62. As shown in FIG. 4, FIG. 6 and FIG. 7, when the first slide rail 28 is located at the second mounting position M2, the first connecting hole 62 is located at a position corresponding to the second connecting hole 64, such that the second connecting member 60 can pass through the first connecting hole 62 and the second connecting hole 64 to fix the first slide rail 28 onto the supporting bracket 26.

Preferably, at least one predetermined structure is arranged on one of the supporting bracket 26 and each of the plurality of slide rails. In this embodiment, by way of example, a plurality of predetermined structures are arranged on the first slide rail 28 or the second slide rail 30. The plurality of predetermined structures at least include a first predetermined structure 66 and a second predetermined structure 68. The plurality of predetermined structures are arranged at intervals along the longitudinal direction. As shown in FIG. 7, each of the plurality of predetermined structures is configured to abut against the main body portion 32 of the supporting bracket 26, so as to increase a structural strength or a supporting strength when the first slide rail 28 is fixed on the supporting bracket 26.

Preferably, each of the slide rails includes a first lateral side and a second lateral side opposite to the first lateral side along the transverse direction. For example, as shown in FIG. 4 and FIG. 7, the first slide rail 28 includes a first lateral side L1 and a second lateral side L2 opposite to the first lateral side L1 along the transverse direction. The first lateral side L1 is located adjacent to the second predetermined lateral side Lb of the supporting bracket 26. A channel 69 is formed on the second lateral side L2. The first predetermined structure 66 includes a recessed portion 70 and a protruding portion 72. The recessed portion 70 is located in the channel 69 on the second lateral side L2. The protruding portion 72 is located on the first lateral side L1 and configured to abut against the main body portion 32 of the supporting bracket 26.

Preferably, one of the auxiliary member 50 and the second connecting member 60 is configured to pass through the corresponding predetermined structure from the recessed portion toward the protruding portion of the corresponding predetermined structure. For example, as shown in FIG. 4 and FIG. 7, the auxiliary member 50 is configured to pass through the first predetermined structure 66 from the recessed portion 70 of the first predetermined structure 66 toward the protruding portion 72 of the first predetermined structure 66 and protrudes from a surface of the protruding portion 72 of the first predetermined structure 66, so as to be mounted on the mounting structure 48 of the supporting bracket 26. On the other hand, the second connecting member 60 is configured to pass through the second predetermined structure 68 from a recessed portion of the second predetermined structure 68 toward a protruding portion of the second predetermined structure 68 and protrudes from a surface of the protruding portion of the second predetermined structure 68, so as to be mounted on the second connecting hole 64 of the supporting bracket 26.

Preferably, as shown in FIG. 1, the supporting assembly 20 further includes a plurality of movable rails. In this embodiment, by way of example, the plurality of movable rails at least include a first movable rail 74 and a second movable rail 76, and the first movable rail 74 and the second movable rail 76 are movably mounted on the second lateral side L2 of the first slide rail 28 and a second lateral side of the second slide rail 30, respectively.

Furthermore, the first movable rail 74 is movably mounted in the channel 69 on the second lateral side L2 of the first slide rail 28. It should be noticed that the auxiliary member 50 is located in the recessed portion 70, i.e., the auxiliary member 50 does not protrude out of the recessed portion 70, and therefore, the auxiliary member 50 does not interfere with the first movable rail 74 when the first movable rail 74 moves in the channel 69. Besides, in order to prevent any movement interference of the first movable rail 74, the second connecting member 60 does not protrude out of the recessed portion, either. Preferably, as shown in FIG. 1, the supporting assembly 20 further includes a first supporting rail 78 movably mounted on the first movable rail 74. The first slide rail 28, the first movable rail 74 and the first supporting rail 78 can form a first slide rail assembly with three-section design and switchable between an extended state and a retracted state.

The second movable rail 76 is movably mounted in the channel 69 on the second lateral side L2 of the second slide rail 30. Preferably, as shown in FIG. 1, the supporting assembly 20 further includes a second supporting rail 80 movably mounted on the second movable rail 76. The second slide rail 30, the second movable rail 76 and the second supporting rail 80 can form a second slide rail assembly with three-section design and switchable between an extended state and a retracted state.

Preferably, the first supporting rail 78 and the second supporting rail 80 can be used to support carried objects, e.g., electronic apparatuses, drawers or alike.

Preferably, as shown in FIG. 7, the supporting bracket 26 has a first predetermined height H1, and each of the plurality of slide rails, i.e., each of the first slide rail 28 and the second slide rail 30, has a second predetermined height H2, and the first predetermined height H1 is greater than or equal to twice of the second predetermined height H2.

In conclusion, the supporting assembly 20 includes the following characteristics.

1. The plurality of slide rails, e.g., the first slide rail 28 and the second slide rail 30, can be mounted on the rack 22 by the same supporting bracket 26, such that it is easy for the user to mount the first slide rail 28 and the second slide rail 30 on the rack 22.
2. In contrast to a front connector and a rear connector in the prior art, the first end portion 28*a* and the second end portion 28*b* of the first slide rail 28, e.g., the front end portion and the rear end portion of the first slide rail 28, can be easily mounted on the first post 24*a* and the second post 24*b* by the first mounting feature 34 and the second mounting feature 38 of the supporting bracket 26 having the first predetermined end portion 26*a* protruding from the first end portion 28*a* of the first slider rail 28 along the longitudinal direction, and the second predetermined end portion 26*b* of the supporting bracket 26 located between the middle portion 28*c* and the second end portion 28*b* of the first slide rail 28 along the longitudinal direction.
3. The auxiliary member 50 is located in the recess portion 70, i.e., the auxiliary member 50 does not protrude out of the recessed portion 70, and therefore, the auxiliary member 50 does not interfere with the first movable rail 74 when the first movable rail 74 moves in the channel 69.
4. When it is desired to mount the first slide rail 28 and the second slide rail 30 on the rack 22, the user can mount the supporting bracket 26 on the rack 22 before or after mounting the first slide rail 28 and the second slide rail 30 on the supporting bracket 26 according to practical demands.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A supporting assembly configured to be mounted to a rack, the supporting assembly comprising:

a supporting bracket configured to be mounted on the rack, the supporting bracket comprising a first predetermined end portion and a second predetermined end portion opposite to the first predetermined end portion along a longitudinal direction;

a plurality of slide rails configured to be detachably mounted on the supporting bracket and comprising a first slide rail and a second slide rail, each of the plurality of slide rails comprising a first end portion, a second end portion and a middle portion, the second end portion being opposite to the first end portion along the longitudinal direction, the middle portion being located between the first end portion and the second end portion along the longitudinal direction;

a first movable rail movably mounted on the first slide rail;

a second movable rail movably mounted on the second slide rail;

a first supporting rail movably mounted on the first movable rail; and a second supporting rail movably mounted on the second movable rail;

wherein one of the first supporting rail and the second supporting rail is configured to support a carried object;

wherein the first predetermined end portion of the supporting bracket protrudes from the first end portion of each of the plurality of slide rails along the longitudinal direction, and the second predetermined end portion of the supporting bracket is located between the middle portion and the second end portion of each of the plurality of slide rails along the longitudinal direction, so as to be recessed from the second end portion of each of the plurality of slide rails.

2. The supporting assembly of claim 1, wherein the supporting bracket further comprises a main body portion located between the first predetermined end portion and the second predetermined end portion of the supporting bracket along the longitudinal direction, and a first mounting feature is arranged on the main body portion and configured to be mounted on a first corresponding feature on the rack.

3. The supporting assembly of claim 2, wherein a second mounting feature is arranged on the main body portion and configured to be mounted on a second corresponding feature on the rack.

4. The supporting assembly of claim 3, wherein the first mounting feature and the second mounting feature are identical to each other, and the first mounting feature and the second mounting feature are located adjacent to the first predetermined end portion and the second predetermined end portion of the supporting bracket, respectively.

5. The supporting assembly of claim 4, wherein the first mounting feature is a protrusion, and the protrusion comprises a first segment connected to the main body portion and a second segment bent relative to the first segment.

6. The supporting assembly of claim 5, wherein the first segment and the second segment are perpendicularly connected to each other.

7. The supporting assembly of claim 6, further comprising a connecting member configured to fix the supporting bracket onto the rack.

8. The supporting assembly of claim 3, wherein a plurality of mounting structures are arranged on the main body portion of the supporting bracket and located between the first mounting feature and the second mounting feature along the longitudinal direction, and the plurality of slide rails are configured to be mounted on the plurality of mounting structures.

9. The supporting assembly of claim 8, wherein each of the plurality of mounting structures is a key hole structure, and an auxiliary member is arranged on each of the plurality of slide rails and configured to be mounted onto the key hole structure.

10. The supporting assembly of claim 9, further comprising a connecting member configured to fix one of the plurality of slide rails onto the supporting bracket.

11. The supporting assembly of claim 8, wherein a predetermined structure is arranged on one of the supporting bracket and each of the plurality of slide rails and configured to abut against another one of the supporting bracket and each of the plurality of slide rails.

12. The supporting assembly of claim 11, wherein the predetermined structure is arranged on each of the plurality of slide rails and configured to abut against the main body portion of the supporting bracket.

13. The supporting assembly of claim 12, wherein each of the plurality of slide rails comprises a first lateral side and a second lateral side opposite to the first lateral side along a transverse direction, the first lateral side is located adjacent to the supporting bracket, the predetermined structure comprises a recessed portion and a protruding portion, the recessed portion and the protruding portion are located on the second lateral side and the first lateral side of each of the plurality of slide rails, respectively, and the protruding portion is configured to abut against the main body portion of the supporting bracket.

14. The supporting assembly of claim 1, wherein the supporting bracket has a first predetermined height, each of the plurality of slide rails has a second predetermined height, and the first predetermined height is greater than or equal to twice of the second predetermined height.

15. A supporting assembly comprising:

a supporting bracket comprising a first predetermined end portion, a second predetermined end portion and a main body portion, the second predetermined end portion being opposite to the first predetermined end portion along a longitudinal direction, the main body portion being located between the first predetermined end portion and the second predetermined end portion along the longitudinal direction; and a plurality of slide rails configured to be detachably mounted on the supporting bracket and comprising a first slide rail and a second slide rail, the first slide rail and the second slide rail having substantially identical structures, each of the plurality of slide rails comprising a first end portion, a second end portion and a middle portion, the second end portion being opposite to the first end portion along the longitudinal direction, and the middle portion being located between the first end portion and the second end portion along the longitudinal direction;

wherein each of the plurality of slide rails further comprises a first lateral side and a second lateral side along a transverse direction, the first lateral side is located adjacent to the supporting bracket, and a channel is formed on the second lateral side and for allowing a movable rail to be mounted thereon;

wherein a predetermined structure is arranged on one of the supporting bracket and each of the plurality of slide rails, and the predetermined structure comprises a protruding portion configured to abut against another one of the supporting bracket and each of the plurality of slide rails;

wherein the first predetermined end portion of the supporting bracket protrudes from the first end portion of each of the plurality of slide rails along the longitudinal direction, and the second predetermined end portion of the supporting bracket is located between the middle portion and the second end portion of each of the plurality of slide rails along the longitudinal direction, so as to be recessed from the second end portion of each of the plurality of slide rails.

16. The supporting assembly of claim 15, wherein the predetermined structure is arranged on each of the plurality of slide rails, the protruding portion of the predetermined structure is located on the first lateral side of each of the plurality of slide rails, and the predetermined structure further comprises a recessed portion located in the channel.

17. The supporting assembly of claim 16, wherein a plurality of mounting structures are arranged on the main body portion of the supporting bracket, the plurality of slide rails are configured to be mounted on the plurality of mounting structures, each of the plurality of mounting structures is a key hole structure, an auxiliary member is arranged on each of the plurality of slide rails and configured to be mounted onto the key hole structure, and the supporting assembly further comprises a connecting member configured to fix one of the plurality of slide rails onto the supporting bracket.

18. The supporting assembly of claim 17, wherein one of the auxiliary member and the connecting member passes through the predetermined structure from the recessed portion toward the protruding portion.

* * * * *